US008622477B2

(12) United States Patent
Colasanti et al.

(10) Patent No.: US 8,622,477 B2
(45) Date of Patent: Jan. 7, 2014

(54) ADJUSTABLE ARMREST FOR A SEATING UNIT

(75) Inventors: John Albert Colasanti, Coopersville, MI (US); Brett William Kooistra, Grand Haven, MI (US)

(73) Assignee: L & P Property Management Company, South Gate, CA (US)

( * ) Notice: Subject to any disclaimer, the term of this patent is extended or adjusted under 35 U.S.C. 154(b) by 310 days.

(21) Appl. No.: 13/024,960

(22) Filed: Feb. 10, 2011

(65) Prior Publication Data

US 2012/0205958 A1 Aug. 16, 2012

(51) Int. Cl.
*A47C 7/54* (2006.01)

(52) U.S. Cl.
USPC ..... 297/411.35

(58) Field of Classification Search
USPC ..... 297/411.35, 411.37, 411.38
See application file for complete search history.

(56) References Cited

U.S. PATENT DOCUMENTS

| | | | | |
|---|---|---|---|---|
| 5,484,187 | A * | 1/1996 | Doerner et al. | 297/411.3 |
| 6,059,366 | A * | 5/2000 | Hu | 297/411.35 |
| 6,948,775 | B2 * | 9/2005 | Tsai | 297/411.37 |
| 6,974,189 | B2 | 12/2005 | Machael et al. | |
| 7,011,371 | B1 | 3/2006 | Tsai | |
| 7,159,947 | B1 * | 1/2007 | Lee | 297/411.37 |
| 7,201,449 | B2 | 4/2007 | Tsai | |
| 7,306,288 | B2 | 12/2007 | Hu et al. | |
| 7,367,628 | B1 * | 5/2008 | Tsai | 297/411.35 |
| 7,559,609 | B2 * | 7/2009 | Tsai | 297/411.35 |
| 7,648,207 | B2 | 1/2010 | Lai | |
| 7,661,763 | B2 | 2/2010 | Tsai | |
| 2002/0070598 | A1 * | 6/2002 | Perl | 297/411.35 |
| 2003/0025378 | A1 * | 2/2003 | Lin | 297/411.35 |
| 2010/0219671 | A1 * | 9/2010 | Huang | 297/411.37 |
| 2011/0248543 | A1 * | 10/2011 | Hitchcock et al. | 297/411.36 |

* cited by examiner

*Primary Examiner* — Peter Brown
(74) *Attorney, Agent, or Firm* — Shook Hardy & Bacon LLP

(57) ABSTRACT

An armrest assembly is provided for adjusting an armrest of a seating unit in three degrees of motion. The armrest assembly includes an angle-adjustment mechanism that allows the armrest to pivot and to translate forward, and a lift mechanism that enables vertical articulation of the armrest. The angle-adjustment assembly includes a pivot bracket with a downwardly disposed pin and a shuttle with an arcuate slot to receive the pin. The arcuate slot includes contoured walls that form detents for restricting movement of the pin, thereby restraining rotation of the shuttle, with respect to the pivot bracket, to predefined angular positions. The lift mechanism includes a rack with ride element(s) extending therefrom and locking teeth, and a control bar with track(s). An upward manual actuation of the control bar causes the track to shift laterally and retract the locking teeth, via interaction between the track(s) and ride element(s), respectively.

13 Claims, 6 Drawing Sheets

ADJUSTABLE ARMREST FOR A SEATING UNIT

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

Conventional seating units (e.g., office chairs) often include armrests for supporting an arm of an occupant and include a seat and a backrest to support the occupant's body in an essentially seated disposition. In some models of seating units, the armrests are configured to move vertically to cope with occupants that have differing arm lengths. However, the apparatuses presently provided to achieve this vertical movement include complex assemblies (e.g., including rotating shafts) that are difficult for the occupant to manipulate and complicated to assemble. Further, these seating units fail to incorporate additional apparatuses for adjusting the armrest in various other degrees of motion that would maximize the ergonomic fit to the occupant.

Accordingly, embodiments of the present invention relate broadly to an armrest assembly that is installed to a seating unit and designed adjust an armrest of the seating unit in three different degrees of motion. This armrest assembly includes various mechanisms to effectuate the degrees of adjustment, wherein the mechanisms are effortless to operate and simply built.

BRIEF SUMMARY OF THE INVENTION

Accordingly, the present invention seeks to provide an improved seating feature, which can be integrated in essentially any type of seating unit, such as an office chair. The seating feature relates to an adjustable armrest that may be adjusted in three degrees of movement. One degree of movement pertains to vertically adjusting the armrest via a lift mechanism. The other degrees of movement pertain to angularly articulating and translatably sliding the armrest forward and rearward, with respect to a seat and/or backrest of the seating unit, via an angle-adjustment mechanism. As more fully discussed below, these mechanisms function in concert to provide an occupant of the seating unit an ergonomically optimized seating experience and to adapt to occupants of varying physical characteristics.

Initially, the lift mechanism includes an actuation lever, a support member, a rack, a control bar, and a biasing device (e.g., compression spring). In embodiments, the support member is coupled to the armrest of the seating unit via the angle-adjustment mechanism. Typically, the support member includes a ribbed portion comprising lateral bars extending therefrom. In addition, the support member may include an upper anchor for retaining a first end of the biasing device.

In an exemplary embodiment, the rack includes a series of locking teeth protruding outward therefrom. Also, the rack includes ride element(s) and a ribbed portion that slidably engages with the ribbed portion of the support member. This slidable engagement of the ribbed portions serves to impede vertical movement of the rack, but allows lateral shifting of the rack. The control bar includes a lower anchor to retains a second end of the compression device and track(s) that receive the ride elements, respectively. In operation, the control bar is configured to shift longitudinally, under the manual actuation of an occupant of the seating unit, with respect to the support member.

The anchoring of the biasing device, as discussed above, allows the biasing device to impart a sustained downward force on control bar with respect to the support member. When the manual actuation of the occupant involves an upward force on the control bar (e.g., pressing on the actuation lever inserted into the control bar) that overcomes the downward force of the biasing device, the control bar is vertically raised with respect to the support member. This raise of the control bar, in turn, causes the rack to laterally shift with respect to the support member. In an exemplary embodiment, the lateral shift of the rack is guided by an interaction between the ride element(s) and the track(s), respectively. Once the control bar is fully raised, the rack assumes a retracted condition that disengages the locking teeth. The disengagement promotes vertical manipulation of the armrest to a precisely adjusted location that meets ergonomic preferences of the occupant.

After the precisely adjusted location is arrived upon, the occupant of the seating unit may elect to establish the armrest in that location. This may be achieved by diminishing the upward force on the control bar (e.g., releasing pressure on the actuation lever) below the downward force of the biasing device. At this point, under the influence of the biasing device, the control bar is lowered with respect to the support member. This lowering of the control bar, in turn, causes the rack to laterally shift with respect to the support member. Once the control bar is fully lowered, the rack assumes an extended condition that engages the locking teeth. The engagement prevents unintentional vertical movement of the armrest and supports an arm of the occupant when resting on the armrest of the seating unit.

Generally, the angle-adjustment mechanism includes a shuttle, a compressive device, a detent key, a rail, and a pivot bracket. Typically, the angle-adjustment mechanism is coupled to a mounting plate, a pivot pin for securing the pivot bracket to the mounting plate, and a moveable housing. In embodiments, the angle-adjustment mechanism enables two degrees of articulation of the armrest. Specifically, the angle-adjustment mechanism may allow the armrest to translate fore and aft with respect to the seating unit, while facilitating selective pivotal adjustment of the armrest. As such, the occupant may employ the angle-adjustment mechanism to easily and conveniently adjust the armrest, while seated in the seating unit, to satisfy his or her ergonomic preferences.

Initially, the moveable housing is assembled to the armrest of the seating unit. The moveable housing includes a lower plate and a plurality of walls extending upward from the lower plate. In an exemplary embodiment, the lower plate includes an elongate slot formed therein. The mounting plate includes an upwardly disposed post element that, at least, partially extends through the elongate slot. The pivot bracket of the angle-adjustment assembly may be attached to the post element, as mentioned above. In addition, the pivot bracket includes a bushing, an arm radially extending from the bushing, and a pin downwardly disposed from the arm. The shuttle is rotatably coupled to the bushing of the pivot bracket. Further, the shuttle includes an arcuate slot for receiving the pin of the pivot bracket.

In an exemplary embodiment, the arcuate slot includes section(s) that are configured with a width that is undersized with respect to a thickness of the pin. That is, an interference is designed into an interaction between the arcuate slot and the pin. This interference acts to restrain any free rotation of the shuttle with respect to the pivot bracket. Typically, the arcuate slot includes a distal wall and a proximal wall with respect to the bushing. In one instance, the undersized sections of the arcuate slot, with respect to the pin, represent contours on the distal and proximal walls that form a set of detents. In operation, the set of detents define a plurality of predefined angular positions of the armrest. In another instance, the undersized sections of the arcuate slot represent substantially smooth surfaces on the distal and proximal walls, such that a continuous range of angular positions is provided by the arcuate slot. The continuous range of angular position is made possible, in part, upon the shuttle being composed of a flexible material. In this way, the interference created between the undersized width of the arcuate slot and the thickness of the pin results in a compression of the distal and proximal walls against the pin.

With respect to the fore-and-aft translation of the angle-adjustment mechanism, the shuttle may include a cavity bored therein, where the compressive device (e.g., compression spring) is received within the cavity. In embodiments, one end of the compressive device may be held in place by a chamber wall of the cavity, while an opposed end of the compressive device may be coupled to the detent key causing a resistive force between the detent key and rail. In operation, upon applying a lateral force to the moveable house the occupant overcomes the resistive force causing fore-aft movement and forcing the detent key across the rail.

The rail may be removably installed to the moveable housing and may be reversible to accomplish differing feels during translational movement of the angle-adjustment mechanism. Generally, the rail may be fabricated with at least one face, where the face of the rail physically interfaces with the detent key to restrain translation of the moveable housing with respect to the mounting plate. In one instance, the face includes contours that form a set of detents, which define a plurality of predefined translational positions of the moveable housing with respect to the mounting plate. In another instance, the face includes a substantially smooth surface, such that a continuous range of transitional positions is provided by the rail. In an exemplary embodiment, the rail is composed of a flexible material that assists the physical interface, or contact, between the detent key and the substantially smooth surface of the rail in frictionally holding the shuttle in a particular transitional position.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

BRIEF DESCRIPTION OF THE SEVERAL VIEWS OF THE DRAWING

Illustrative embodiments of the present invention are described in detail below with reference to the attached drawing figures, which are incorporated by reference herein. In the accompanying drawings, which form a part of the specification and which are to be read in conjunction therewith, and in which like reference numerals are used to indicate like parts in the various views.

DETAILED DESCRIPTION OF THE INVENTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or varying components/materials similar to the ones described in this document, in conjunction with other present or future technologies.

Generally, embodiments of the present invention relate to an armrest mechanism for adjusting an armrest of a seating unit along three degrees of motion. As used herein, the phrase "seating units" is not meant to be limited to office chairs similar to the type illustrated in FIG. 1. Instead, seating units refer broadly to any style of furniture designed to support a user's body in an essentially seated disposition. As such, seating units may include recliners, incliners, sofas, love seats, sectionals, theater seating, traditional chairs, chairs with a moveable seat portion, and other such furniture pieces. Further, a user occupying the seating unit may be described as an occupant, while a user adjusting the armrest mechanism may be described as an operator. However, it should be noted that the terms "operator" and "occupant" both generally relate to a person within proximity of the seating unit, and hereinafter are used interchangeably.

The armrest assembly includes an angle-adjustment mechanism and a lift mechanism to effectuate the three degrees of motion described above. These mechanisms involve a plurality of interconnected components that are arranged to actuate (e.g., slide and/or rotate with respect to one another) and control movement of the armrest between a variety of vertical, translational, and angular positions. Typically, in order to accomplish this actuation of the armrest, the components are coupled together. It is understood and appreciated that these couplings between these components can take a variety of configurations, such as pivot pins, bearings, traditional mounting hardware, rivets, bolt and nut combinations, or any other suitable fasteners that are well-known in the furniture-manufacturing industry. Further, the shapes of the components may vary from the illustrated components in the FIGS. 1-9, as may the locations of certain couplings. It will be understood that when a linkage is referred to as being pivotably "coupled" to, "interconnected" with, "mounted" to, "attached" on, etc., another component, it is contemplated that the components may be in direct contact with each other, or other elements, such as intervening elements/components/mechanisms, may also be present.

Figure 2:
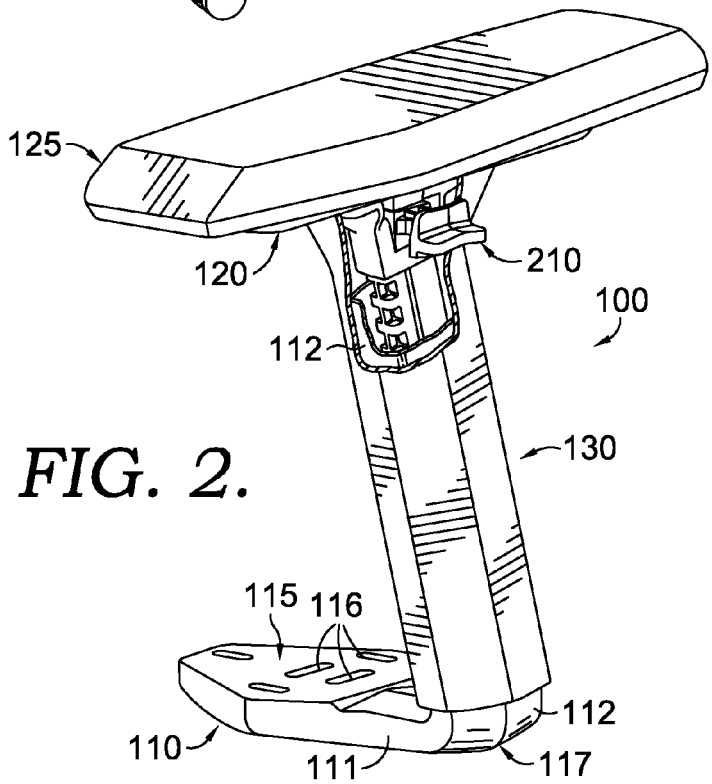
FIG. 2 is diagrammatic perspective view of the armrest assembly with a cut-away section to expose locking teeth of a rack, in accordance with an embodiment of the present invention.

Further, the discussion herein focuses on a single armrest assembly. However, in an exemplary configuration, a pair of armrest are provided on a single seating unit, where movement of the pair of armrests is controlled independently by a pair of armrest assemblies, respectively (one of which is shown in FIG. 2 and indicated by reference numeral 100). Because a rack provided within each of the armrest assemblies is substantially centrally located, each of the pair of armrest assemblies may be substantially similar in design. This is true even when the pair of armrest assemblies is incorporated within both right- and left-side arms, respectively, of the seating unit. As such, the ensuing discussion will focus on only one of the armrest assemblies, with the content being equally applied to the other substantially similar armrest assembly incorporated in a complimentary arm of the seating unit. It should be noted, that this centrally located rack, in combination with the compact design of the lift mechanism, allows the lift mechanism to be housed in varying types of arms, thereby minimizing the investment to manufacture specific arms with customized styling for accepting the lift mechanisms.

Figure 1:
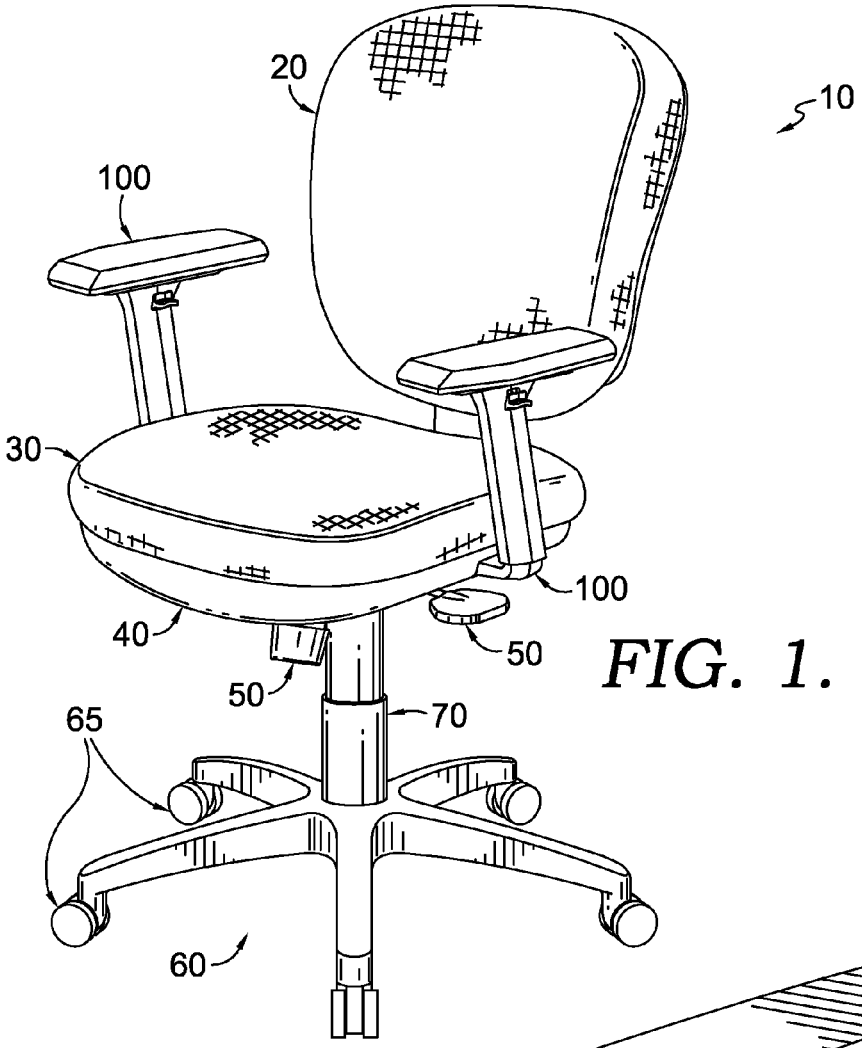
FIG. 1 is a diagrammatic perspective view of seating unit that has an armrest assembly installed thereto, in accordance with an embodiment of the present invention.

Turning to FIG. 1, an exemplary seating unit 10 having adjustable armrests will now be described according to embodiments of the present invention. Initially, the seating unit 10 (e.g., office chair) includes a base 60, a pedestal 70, a seat pan 40, a seat 30, a backrest 20, and control lever(s) 50 for invoking adjustment of the seat 30 and the backrest 20. As illustrated, the base 60 is designed with a hub-and-spoke configuration with castors 65 connected to each of the spokes, respectively. Further, the castors 65 are located intermediately between the base 60 and an underlying surface (not shown) to facilitate mobilizing the seating unit 10. The pedestal 70 may include a lower end rotatably coupled to the base 60 and an upper end pivotably coupled to the seat pan 40. The seat pan 40 serves to support the seat 30, as well as an occupant thereof. Further, the seat pan 40 may be attached to the armrest assemblies 100.

Referring now to FIG. 2, one of the armrest assemblies 100 will now be described in general. As shown, the illustrative armrest assembly 100 includes an armrest 125 for supporting an arm of an occupant of the seating unit 10, a support 110, a moveable housing 120 assembled to the armrest 125, a sleeve 130, and an actuation lever 210 of the lift mechanism. In embodiments, the armrest assembly 100 is configured with a substantially vertical section 112 and a substantially horizontal section 111 joined by an angled, or L-shaped, portion 117. The substantially vertical section 112 section may be formed as a hollow column that includes an interior surface (see cut-away section of FIGS. 2 and 9). In embodiments, the interior surface holds a locking block (see reference numeral 119 of FIG. 9) extending inward from the interior surface of the support 110. In operation, as discussed more fully below, locking teeth on a rack selectively engage with the locking block when a control bar of the adjustment mechanism is shifted downward. Further, the interior surface may be employed to substantially encapsulate and support the adjustment assembly. In other words, the adjustment assembly is telescopically mounted to the interior surface of the substantially vertical section 112 of the support 110.

The substantially horizontal section 111 of the support 110 includes a mounting surface 115 that assembles the armrest assembly 100 to the seat pan 40 of the seating unit 10. In embodiments, the mounting surface 115 may include a pattern of apertures 116 capable of mounting to a plurality of dissimilar-shaped seat pans, thereby incorporating adaptability into the design of the support 110. Further, the mounting surface 115 is capable of accepting and mating to various spacers in order to lower the adjustment assembly 100 with respect to the seat 30.

Figure 8:
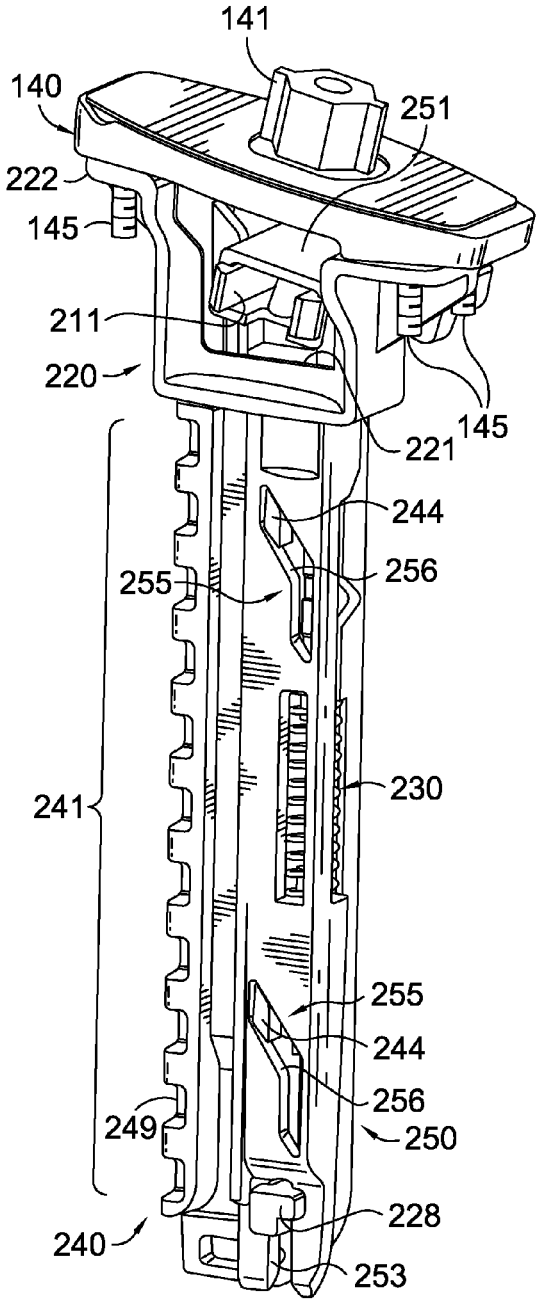
FIG. 8 is a view similar to FIG. 7, but illustrating the lift mechanism adjusted to an extended condition, in accordance with an embodiment of the present invention.
Figure 9:
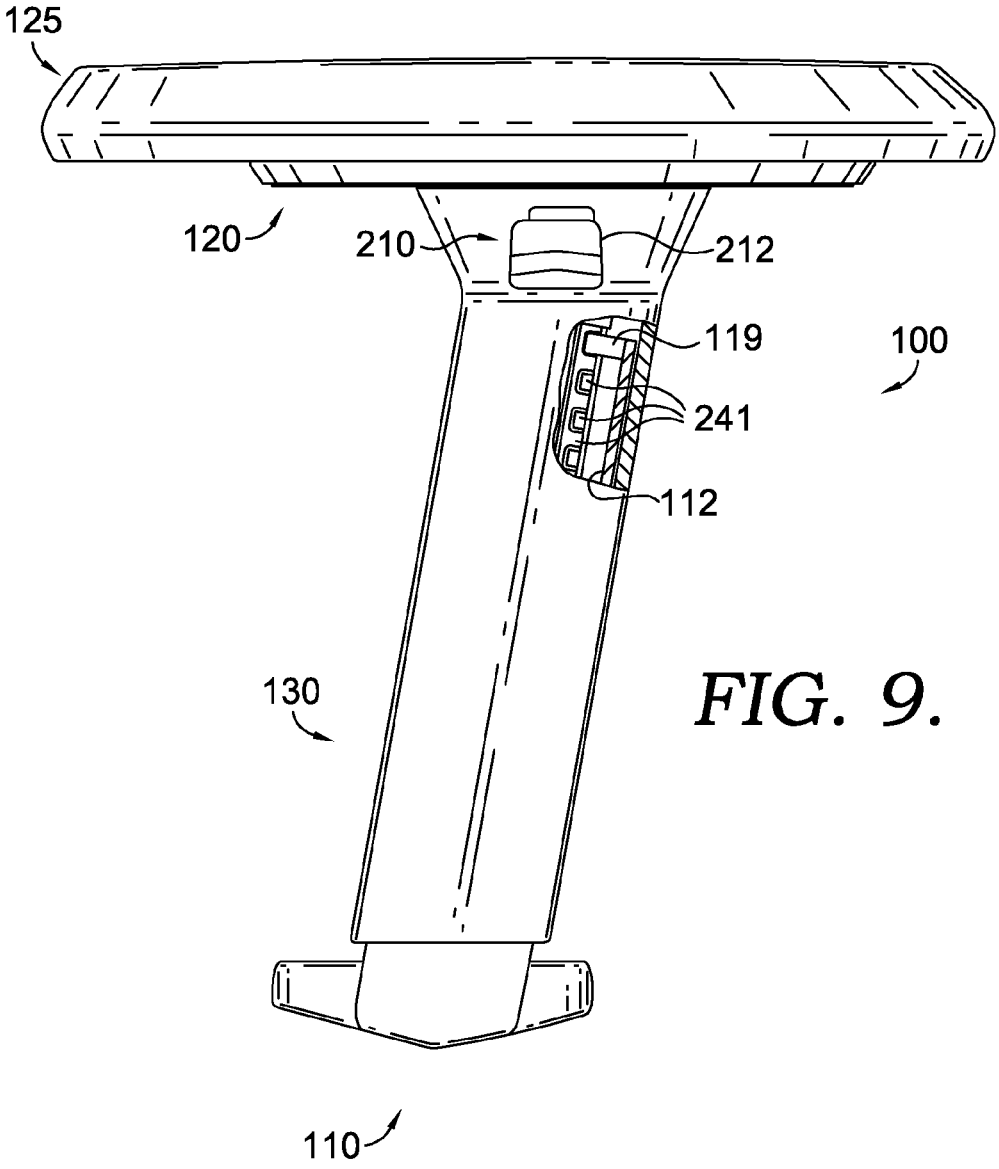
FIG. 9 is an elevation view of the armrest assembly with a cut-away section to expose the locking teeth engaged to a locking block, in accordance with an embodiment of the present invention.

The sleeve 130 is coupled to, and adjustable in accordance with, the lift assembly. In one instance, as shown in FIG. 8, fasteners 145 that couple a mounting plate 140 to a support member 220 of the lift mechanism are employed to couple the sleeve 130 to the lift mechanism as well. Further, the sleeve 130 functions as a housing that covers and protects the lift mechanism. Even further, the sleeve 130 may assume various profiles that provide an aesthetic component to the armrest assembly 100. As depicted in FIG. 9, an upper portion of the sleeve 130 may include an aperture formed therein to allow the actuation lever 210 to extend outward through the sleeve 130. As such, the occupant is provided access to the actuation lever 210, allowing the occupant to manually actuate the lift mechanism.

Figure 4:
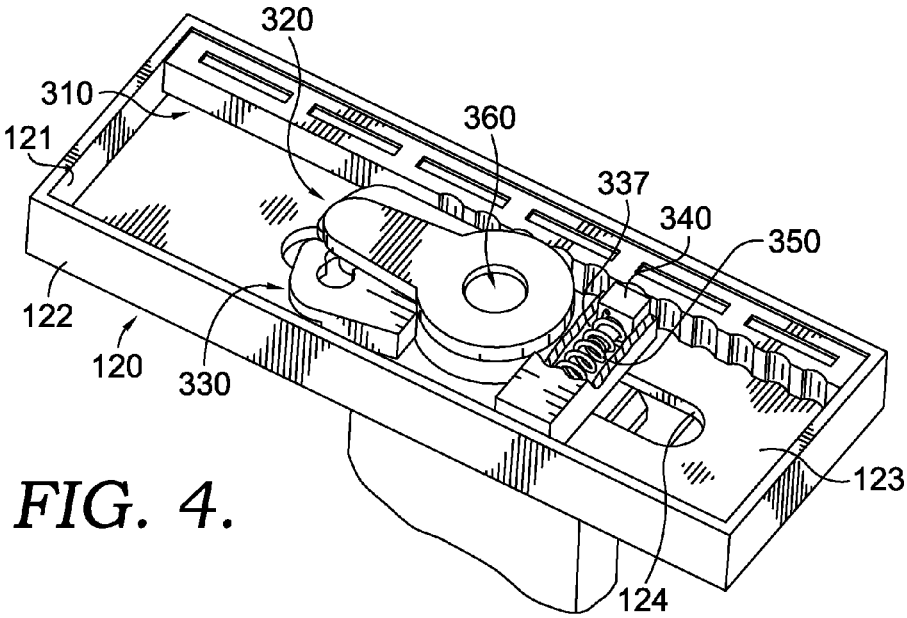
FIG. 4 is a diagrammatic perspective view of the angle-adjustment mechanism, in accordance with an embodiment of the present invention.
Figure 3:
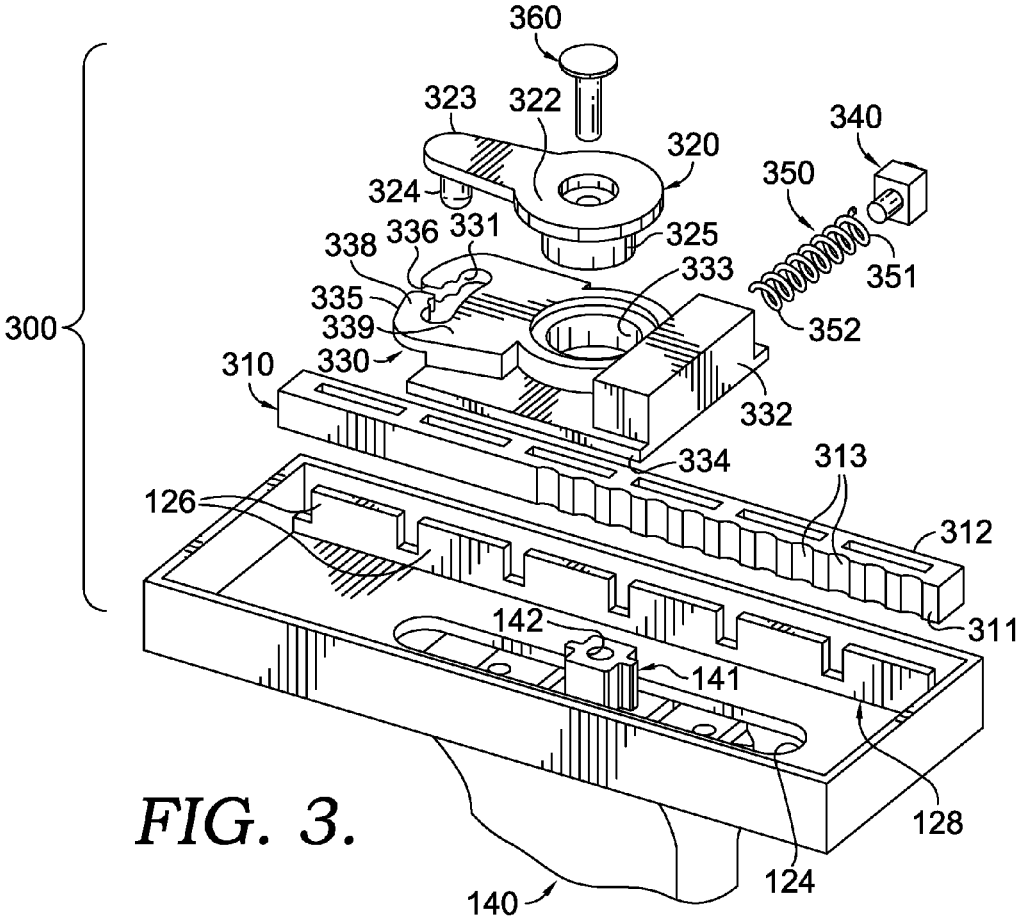
FIG. 3 is an exploded view of an angle-adjustment mechanism, in accordance with an embodiment of the present invention.

Turning to FIGS. 3 and 4, components of the angle-adjustment mechanism 300 will now be discussed, in accordance with embodiments of the present invention. Generally, the angle-adjustment mechanism 300 includes a rail 310, a pivot bracket 320, a shuttle 330, a detent key 340, and a compressive device 350. Typically, the angle-adjustment mechanism 300 is coupled to the mounting plate 140. In one instance, a pivot pin 360 may be provided for securing the pivot bracket 320 to a post element 141 extending upward from the mounting plate 140. As illustrated, the pivot pin 360 is received into a bore that is axially aligned with a downward-disposed bushing 325 of the pivot bracket 320 and is received into a vertical cavity 142 bored into the post element 141.

Generally, the angle-adjustment mechanism 300 also is coupled to the moveable housing 120. In one embodiment, the moveable housing 120 includes a beam 128 with fins 126 formed therein, a lower plate 123, and walls 122 attached to the lower plate 123. The walls 122 may include four adjoining plates that extend upwardly from the lower plate 123 and form a perimeter around the lower plate 123. This perimeter may act to partially enclose the angle-adjustment mechanism 300, as well as assemble to the armrest 125 of FIG. 2. The walls 122 may include an inner surface 121 that guides fore-and-aft translation of the moveable housing 120 with respect to the shuttle 330. In an exemplary embodiment, the lower plate 123 includes an elongate slot 124 formed therein. The post element 141 of the mounting plate 140 may extend through the elongate slot 124, in effect, helping to guide the fore-and-aft translation of the moveable housing 120 with respect to the mounting plate 140.

Typically, the pivot bracket 320 of the angle-adjustment mechanism 300 may be securely coupled to the post element 141, as mentioned above. In addition, the pivot bracket 320 includes the bushing 325, a base plate 322 from which the bushing 325 is downwardly disposed, an arm 323 radially extending from the base plate 322, and a pin 324 downwardly disposed from the arm 323. Generally, the pivot bracket 320 is composed of a hard material, such as plastic. In an particular case, the plastic may be polyacetal or any other thermoplastic material used in precision parts, where the thermoplastic material offers a high level of stiffness, low friction, and excellent dimensional stability.

In an exemplary embodiment, the shuttle 330 includes a base plate 334, a centrally positioned bushing 333 with a bore formed therein, a raised housing 332 with a cavity 337 bored therein, and an arcuate slot 331 that has a distal wall 338 and a proximal wall 339, with respect to the bushing 333. In one configuration, the arcuate slot 331 includes a cutout 336 in the distal wall 338, where the cutout 336 divides the distal wall 338 into a pair of fingers 335, or wings. When the shuttle 330 is composed of a flexible material, one or both of the fingers 335 may deflect elastically upon the pin 324 of the pivot bracket 320 transitioning within the arcuate slot 331, as discussed more fully with respect to FIG. 5.

The arcuate slot 331 generally includes section(s) that are configured with a width that is undersized with respect to a thickness of the pin 324. That is, an interference is designed into an interaction between the arcuate slot 331 and the pin 324. This interference acts to restrain any free rotation of the shuttle 330 (in conjuncture with the moveable housing 120), with respect to the pivot bracket 320. In one instance, the undersized sections of the arcuate slot 331, with respect to the pin 324, represent concave and convex contours on the distal wall 338 and/or the proximal wall 339, where the contours form a set of detents. In other instances, the contours include notches, grooves, slits, or other textures machined into one or more of the walls 338 and 339. In operation, the set of detents define a plurality of predefined angular positions of the armrest, such as B and B' of FIG. 5. When the pin 324 is moved between angular positions within the set of detents, one or both of the fingers 335 may deflect elastically to allow rotation of the shuttle 330. However, the fingers 335 collapse upon the pin 324 and hold it firmly in a targeted angular position upon the occupant reducing a rotational force applied to the armrest 125 and, by extension, to the shuttle 330.

In another instance, the undersized sections of the arcuate slot 331 each represent a substantially smooth surface on the distal wall 338 and/or the proximal wall 339. In this way, a continuous range of angular positions is provided by the arcuate slot 331. The continuous range of angular position is made possible, in part, when the shuttle 330 is composed of a flexible material (e.g., nylon) that may be elastically compressed. The flexible material will naturally apply a restoring force to push outwardly at a point of compression. Accordingly, the restoring force seizes the pin 324 between the walls 338 and 339 at the point of interference and temporarily holds the shuttle 330 in an angular position with respect to the pivot bracket 320.

Although various different configurations of the arcuate slot 331 have been described, it should be understood and appreciated that other types of suitable configurations of an "arcuate slot" may be used, and that embodiments of the present invention are not limited to the specific designs of the arcuate slot 331 described herein. For instance, the arcuate slot 331 may comprise a single pivoting spring arm that is formed upon removing one side wall connecting the distal wall 338 and the proximal wall 339. In another instance, there are no cut-outs within walls of the actuate slot 331, such the arcuate slot 331 represents a completely closed loop. In operation, the embodiment with a closed arcuate slot 331 includes a relatively thin distal wall 338 that flexes inward (to capture the pin 324) and outward (to allow translation of the pin 324), thereby providing a type of spring tension on the pin 324. As such, embodiments of the present invention contemplate a wide variety of configurations of the arcuate slot 331; thus, the arcuate slot 331 should not be construed as being limited to a particular design, but may encompass any slot, aperture, groove, fingers, etc., that act to selectively hold in tension a pin while allowing the pin to translate upon a user applying a threshold amount of angular force (moment) to the armrest.

With respect to the fore-and-aft translation of the angle-adjustment mechanism 300, the raised housing 332 of the shuttle 330 may include a laterally oriented cavity 337 bored therein. As depicted in the cut-away section of FIG. 4, the compressive device 350 (e.g., compression spring, deformable tube, and the like) is received within the cavity 337. In embodiments, one end 352 of the compressive device 350 may be held in place by a chamber wall of the cavity 337, while an opposed end 351 of the compressive device 350 may be coupled to the detent key 340, thus, spring-loading the detent key 340 in an outwardly biased direction. In operation, upon applying a directional force to the detent key 340, which overcomes a resistance inherent to the compressive device 350, the detent key 340 is configured to traverse an opening of the cavity 337.

The rail 310 may be removably installed to the fins 126 of the moveable housing 120 and may be reversible to accomplish differing feels during translational movement of the angle-adjustment mechanism 300. Generally, the rail 310 may be fabricated with a number of faces 311 and 312, where each face of the rail 310 physically interfaces with the detent key 340 to restrain translation of the moveable housing 120 with respect to the mounting plate 140. In one instance, the face 311 includes contours that form a set of detents 313, which define a plurality of predefined translational positions of the moveable housing 120, such as transitional positions A (detent 313) and A' (detent 313') of FIG. 5. In another instance, the face 312 includes a substantially smooth surface. In this instance, a continuous range of transitional positions may be provided by the smooth-surfaced face 312 of the rail 310.

In an exemplary embodiment, the rail 310 is composed of a flexible material that assists the physical interface, or contact, between the detent key 340 and the smooth-surfaced face 312 of the rail 310 in frictionally holding the shuttle 330 in a particular transitional position. The flexible material may comprise a soft-durometer rubber or any other material that permits slight compressions/deflections for inhibiting the detent key 340 from freely sliding over a face of the rail 310. As such, the flexible material within the rail 310 imposes a rubbing action against the detent key 340. Further, a variety of interchangeable rails 310 that have differing levels of flexibility, or stiffness, may be provided with the armrest assembly 100 to furnish the occupant a selection of break-away forces for invoking fore-and-aft translation of the armrest 125.

Figure 5:
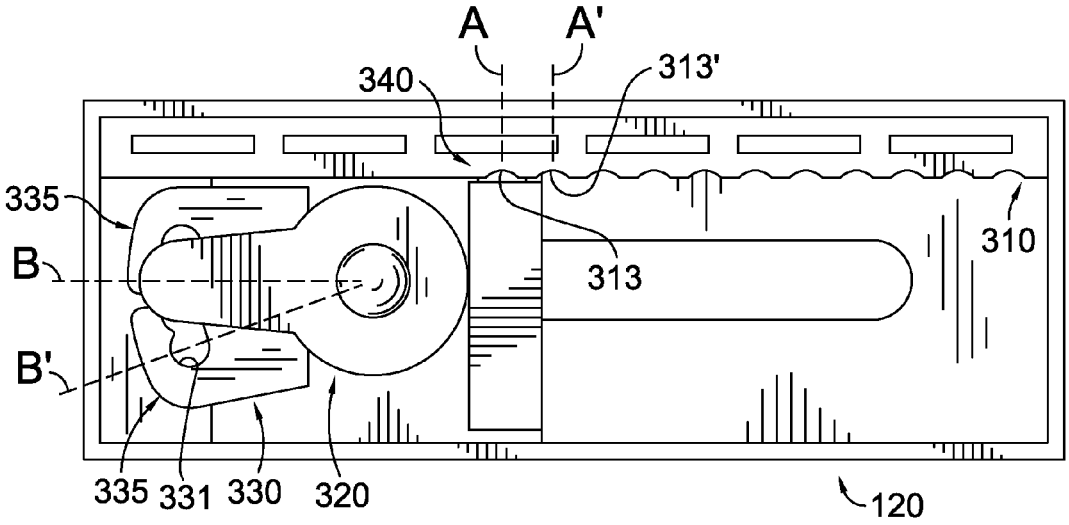
FIG. 5 is an elevation view of the angle-adjustment assembly installed to a moveable housing, in accordance with an embodiment of the present invention.

With reference to FIG. 5, operation of the angle-adjustment mechanism 300 will now be discussed, in accordance with embodiments of the present invention. As discussed above, the angle-adjustment mechanism 300 enables two degrees of articulation of the armrest 125. In embodiments, the angle-adjustment mechanism 300 may allow the armrest to translate fore and aft with respect to the seating unit. The fore-and-aft translation may be restrained by detents 313 in the face 311 of the rail 310. In this way, the detents 313 and 313' define translational positions A and A', respectively. Further, the angle-adjustment mechanism 300 may allow the occupant to selectively, pivotably adjustment of the armrest 125. In embodiments, the angle-adjustment mechanism 300 may allow the armrest to pivotably adjust upon sliding the pin 324 over the detents on the walls 338 and 339 of the arcuate slot 331 formed in the shuttle 330. In this way, the pivotably adjustment may be restrained by detents, such that the detents that define angular positions B and B', where B' is angularly offset in comparison with position B. As such, the occupant may employ the single angle-adjustment mechanism 300 to easily and conveniently translate and pivot the armrest 125, while seated in the seating unit, to satisfy his or her ergonomic preferences.

Turning to FIGS. 6-9, the configuration of the lift mechanism 200 will now be discussed. Initially, the lift mechanism 200 includes an actuation lever 210, a support member 220, an internal locking rack 240, a control bar 250, and a biasing device 230 (e.g., compression spring). As discussed above, the support member 220 is coupled to the mounting plate 140 via fasteners 145. In embodiments, an upper portion 222 of the support member 220 is provided with mating pads 223 with a pattern of holes 224 formed (e.g., drilled of molded) therein. The holes are configured to receive the fasteners 145. Once assembled via the fasteners 145, the mating pads 223 are held tightly against a lower surface of the mounting plate 140.

Figure 6:
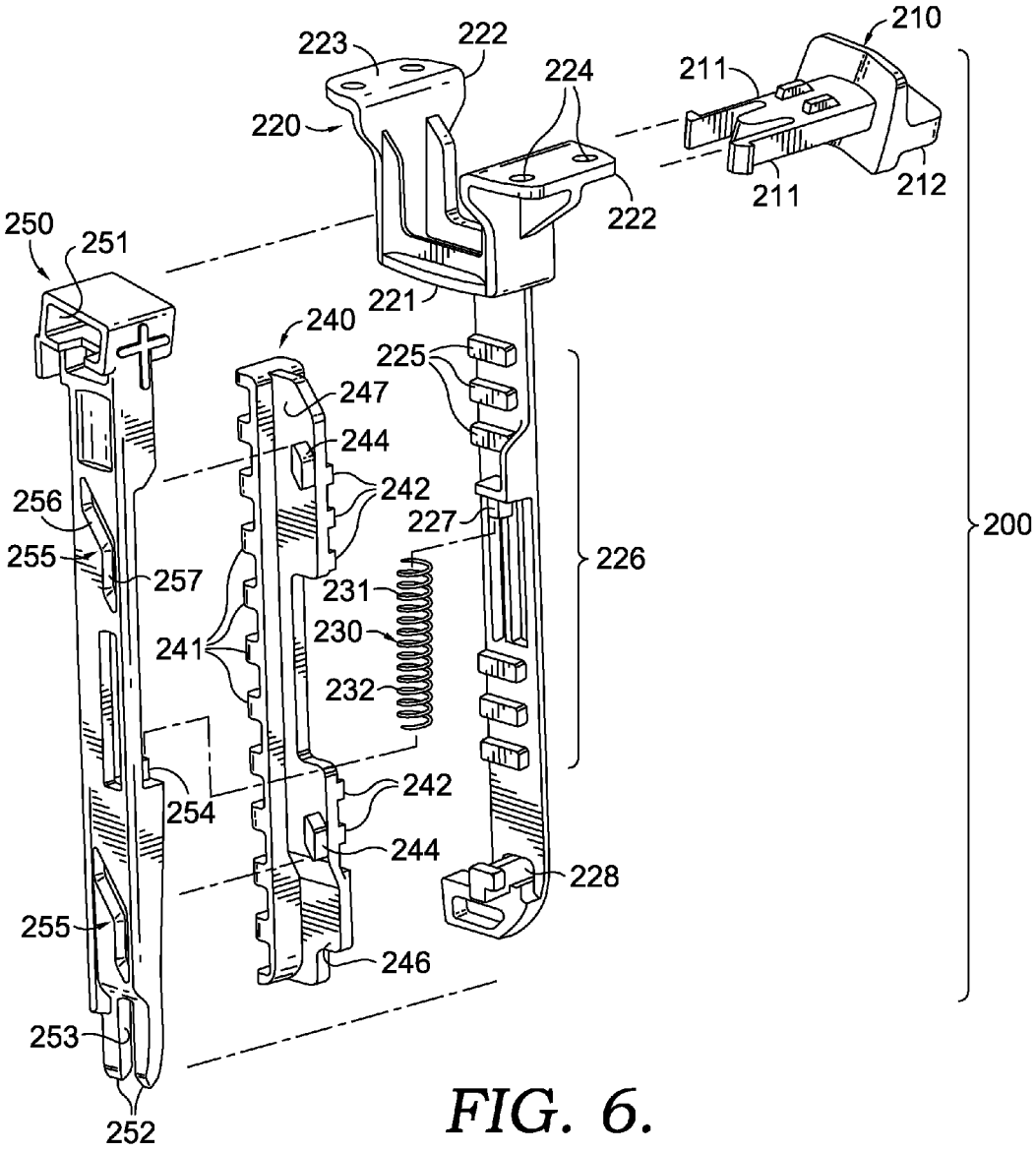
FIG. 6 is an exploded view of a lift mechanism, in accordance with an embodiment of the present invention.

Typically, the support member 220 includes a ribbed portion 226 comprising lateral bars 225 extending therefrom. As illustrated in FIG. 6, the lateral bars 225 are evenly spaced, substantially parallel, rectangular protrusions that are aligned on a single surface of the support member 220. In addition, the support member 220 may include an upper anchor 227 for retaining a first end 231 of the biasing device 230 (e.g., compressive device 350, helical spring, or any other device that imparts a constant and uniform directional force when compressed). In one instance, the upper anchor 227 is configured as a downwardly disposed pin that may be inserted into an opening of the biasing device 230, thereby retaining the first end 231. Further, the support member may include a knob 228 with a cap. In one instance, the knob 228 extends from a lower portion of the support member 220.

In an exemplary embodiment, the rack 240 includes a series of locking teeth 241 protruding outward therefrom. In one instance, the locking teeth 241, represent tooth-like protrusions extending outward from an elongate engagement portion of the rack 240. Further, the locking teeth 241 may represent a series of selectively engageable protrusions with vertically aligned openings, or recesses, therebetween. When vertically aligned, the locking teeth 241 may engage with complimenting protrusions (e.g., locking block 119) extending inward from an interior surface of the support 110, thereby supporting the armrest 125 in one of a set of predefined longitudinal positions.

Figure 7:
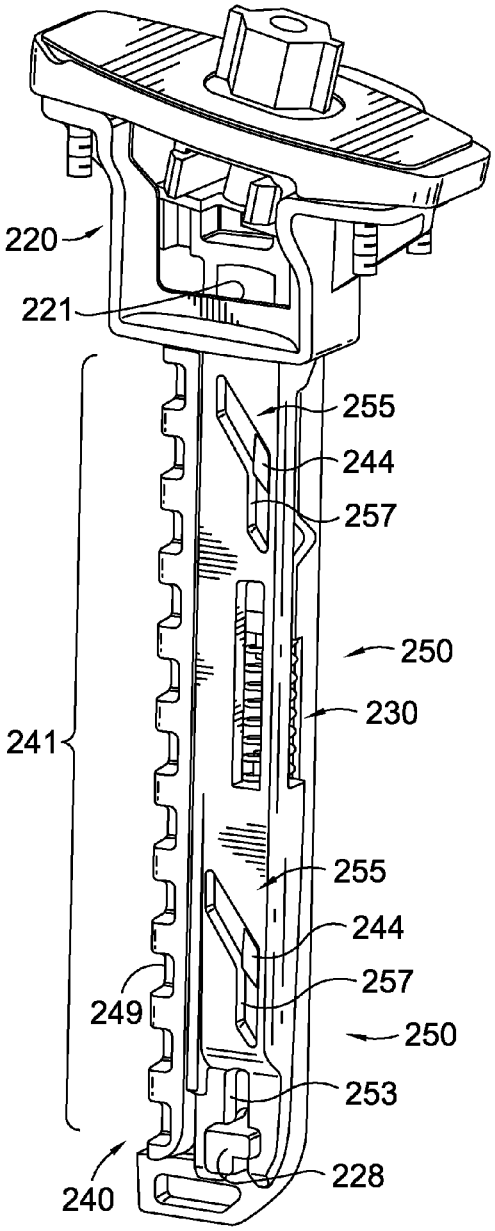
FIG. 7 is a diagrammatic perspective view of the lift mechanism adjusted to a retracted condition, in accordance with an embodiment of the present invention.

As mentioned above, the individual locking teeth 241 are symmetrical and can be used in both left- and right-side configurations of the armrest assembly 100. As illustrated in FIGS. 7 and 8, a spine 249 is provided to reduce flexibility in the locking teeth 241 while increasing the overall surface area of engagement with the locking block 119 of FIG. 9. In a specific model of the lift mechanism 200, the locking teeth 241 are arranged and designed based on a length of travel (e.g., 3 inches of vertical range of movement) and on a number of positions (e.g., 8-10) within the length of travel.

Also, the rack 240 may include ride element(s) 244. These ride element(s) 244 may extend outward from the rack 240 and may, in embodiments, be configured as diamond-shaped wedges. Further, the ride element(s) 244 may be shaped to fit and travel within track(s) 255 formed into the control bar 250. In operation, the tracks(s) 255 slide upward and downward, which guides the ride element(s) 244 and, by extension, the rack 240 to shift laterally.

The rack 240 may further include a ribbed portion with lateral bars 242. In embodiments, the lateral bars 242 may be positioned on an upper portion 247 and/or a lower portion 246 of the rack 240, where gap between the portions 246 and 247 receives the biasing device 230 such that the biasing device 230 is integral to the lift mechanism 200. The lateral bars 242 may be shaped and positioned to compliment the lateral bars 225 extending from the support member 220. Accordingly, the lateral bars 242 of the rack 240 slidably engage with the ribbed portion 226 of the support member 220. In operation, this slidable engagement serves to impede vertical movement of the rack 240, but allows lateral shifting of the rack 240.

The control bar 250 includes a lower anchor 254 to retain a second end 232 of the biasing device 230. In one instance, the lower anchor 254 is configured as an upwardly disposed pin that may be inserted into an opening of the biasing device 230, thereby retaining the second end 232. The control bar 250 may also include the track(s) 255 that receive the ride element(s) 244, respectively. The tracks(s) 255 may be configured with a substantially vertical region 257 and a diagonal region 256 that acts as a ramp to laterally shift the rack 240. Further, the control bar 250 may include an opening 251 in its upper portion and a pair of prongs 252 with a slot 253 therebetween in its lower portion. Generally the knob 228 is captured within the slot 253, thereby guiding the vertical movement of the control bar 250 with respect to the support member 220. In operation, the control bar 250 is configured to shift longitudinally under the manual actuation of an operator of the seating unit.

In an exemplary embodiment, the occupant's manual actuation for vertically adjusting the armrest 125 is directed to the actuation lever 210. The actuation lever 210 includes a knob portion 212 for receiving the occupant's interaction and a pair of hooked prongs 211 that assemble to the opening 251 of the control bar 250. In one instance, the prongs 211 snap into place upon insertion into the opening 215 and temporarily attach the actuation lever 210 to the control bar 250. In an exemplary embodiment, the prongs 211 are adapted to assemble with and secure to either side of the opening 251. In this way, the lift mechanism 200 may housed by either the right-side support 110 or the left-side support 110 while still providing an outwardly directed actuation lever 210 on each of the supports 110.

The operation of the lift mechanism 200 will now be described with reference to FIGS. 7 and 8. Initially, the biasing device 230 imparts a sustained downward force on the control bar 250 with respect to the support member 220. When the manual actuation of the occupant involves an upward force on the control bar 250 (e.g., pushing up on the actuation lever 210 mated with the control bar 250) that overcomes the downward force of the biasing device 230, the control bar 250 is vertically raised with respect to the support member 220. This raise of the control bar 250, in turn, causes the rack 240 (sandwiched between the control bar 250 and the support member 220) to laterally shift with respect to the support member 220.

In an exemplary embodiment, the lateral shift of the rack 240 is guided by an interaction between the ride element(s) 244 and the track(s) 255, respectively. For example, when the lift mechanism 200 is in the extended condition (FIG. 8), the diagonal region 256 of the track(s) 255 acts as a ramp to pull inward the ride element(s) 244 and retract the rack 240 while the control bar 250 is moved upward. Once the control bar 250 is fully raised, the ride element(s) 244 are moved to the substantially vertical region 257 of the track(s) 255. Also, when fully raised, the rack 240 assumes a retracted condition (FIG. 7) that disengages the locking teeth 241 from the locking block 119 of FIG. 9. The disengagement promotes vertical manipulation of the armrest 125 to a precisely adjusted location that meets ergonomic preferences of the occupant.

After the precisely adjusted location is arrived upon, the occupant of the seating unit may elect to establish the armrest 125 in that location. This may be achieved by diminishing the upward force on the control bar 250 (e.g., releasing the actuation level 210) below the downward force exerted by the biasing device 230. At this point, under the influence of the biasing device 230, the control bar 250 is automatically lowered with respect to the support member 220. This lowering of the control bar 250, in turn, causes the rack 240 to laterally shift outward with respect to the support member 220. This outward lateral shift is effectuated by the slidable engagement of the track(s) 255 and the ride element(s) 244 in a procedure reverse in operation to the inward pull described above. Once the control bar 250 is fully lowered, the rack 240 assumes the extended condition that engages the locking teeth 241 with the locking block 119 of FIG. 9. The engagement prevents unintended vertical movement of the armrest 125 and supports an arm of the occupant when resting on the armrest 125 of the seating unit.

It should be understood that the construction of the armrest assembly 100 lends itself to enable easy assembly to, and disassembly from, the seat and/or backrest. Specifically, the design of the mounting surface 115 on the support 110 may allow for use of quick-disconnect hardware, such as a knock-down fastener. Accordingly, rapid disconnection of components of the seating unit 10 prior to shipping, or rapid connection upon receipt, is facilitated.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. An armrest assembly provided for a seating unit, the armrest assembly comprising:

an armrest for supporting an arm of an occupant of the seating unit;

a support fixedly mounted to a seat pan of the seating unit;

a moveable housing having a lower plate and a plurality of walls attached to the lower plate, wherein the lower plate includes an elongate slot formed therein, and wherein the armrest is assembled to the moveable housing;

a mounting plate having an upwardly disposed post element that, at least, partially extends through the elongate slot, wherein the mounting plate is moveably coupled to the support; and an angle-adjustment mechanism for enabling two degrees of articulation of the armrest, the angle-adjustment mechanism comprising:

(a) a pivot bracket attached to the post element, wherein the pivot bracket includes a bushing, an arm radially extending from the bushing, and a pin downwardly disposed from the arm; and (b) a shuttle rotatably coupled to the bushing, wherein the shuttle includes an arcuate slot for receiving the pin, wherein one or more sections of the arcuate slot are configured with a width that is undersized with respect to a thickness of the pin, thereby restraining rotation of the shuttle with respect to the pivot bracket.

2. The armrest assembly of claim 1, wherein the arcuate slot includes a distal wall and a proximal wall with respect to the bushing.

3. The armrest assembly of claim 2, wherein the one or more sections of the arcuate slot that are configured with the undersized width represent contours on the distal and proximal walls that form a set of detents, wherein the set of detents define a plurality of predefined angular positions of the armrest.

4. The armrest assembly of claim 2, wherein a cutout is provided in the distal wall or the proximal wall of the arcuate slot.

5. The armrest assembly of claim 4, wherein the shuttle is composed of a flexible material such that the distal wall or the proximal wall deflect elastically upon translating the pin within the arcuate slot.

6. The armrest assembly of claim 2, wherein the one or more sections of the arcuate slot that are configured with the undersized width comprise substantially smooth surfaces on the distal and proximal walls such that a continuous range of angular positions is provided by the arcuate slot.

7. The armrest assembly of claim 6, wherein the shuttle is composed of a flexible material such that an interference created between the undersized width of the arcuate slot and the thickness of the pin results in a compression of the distal and proximal walls against the pin.

8. The armrest assembly of claim 1, wherein the shuttle includes a cavity, and wherein the angle-adjustment mechanism further comprises:

a compressive device having a first end and a second end, wherein the first end is received within the cavity;

a detent key coupled to the second end of the compressive device, wherein, upon applying a directional force to the detent key that overcomes a resistance inherent to the compressive device, the detent key is configured to traverse an opening of the cavity; and a rail having at least one face, which physically interfaces with the detect key to restrain fore-and-aft translation of the moveable housing with respect to the mounting plate.

9. The armrest assembly of claim 8, wherein the armrest assembly is removably installed to the moveable housing.

10. The armrest assembly of claim 8, wherein the at least one face includes contours that form a set of detents, and wherein the set of detents on the rail define a plurality of predefined translational positions of the moveable housing with respect to the mounting plate.

11. The armrest assembly of claim 10, wherein the rail is composed of a flexible material, and wherein the physical interface represents contact between the detent key and the substantially smooth surface such that the rail frictionally holds the shuttle in a particular transitional position.

12. The armrest assembly of claim 10, wherein the angle-adjustment mechanism further comprises a pivot pin that couples the pivot bracket to the post element of the mounting plate, wherein the pivot pin is received by an aperture through the bushing of the pivot bracket.

13. The armrest assembly of claim 8, wherein the at least one face includes a substantially smooth surface such that a continuous range of transitional positions is provided by the rail.

* * * * *